United States Patent [19]

Fischer

[11] 4,345,711

[45] Aug. 24, 1982

[54] PARTITIONED CARTON

[76] Inventor: David Fischer, 12 Cavotti Crescent, Downsview, Ontario, Canada, M3H 4V1

[21] Appl. No.: 246,676

[22] Filed: Mar. 23, 1981

[51] Int. Cl.[3] ..... B65D 5/46; B65D 5/48

[52] U.S. Cl. ..... 229/41 R; 229/52 B; 229/27

[58] Field of Search ..... 229/41 R, 41 B, 52 B, 229/15, 27

[56] References Cited

U.S. PATENT DOCUMENTS

| | | | |
|---|---|---|---|
| 2,529,695 | 11/1950 | Brulin | 229/27 |
| 2,659,526 | 11/1953 | Buttery | 229/41 B |
| 3,547,339 | 12/1970 | Bruce | 229/52 B |
| 3,794,239 | 2/1974 | Bouczyk | 229/52 B |
| 3,827,550 | 8/1974 | Arneson | 229/41 R |
| 4,146,169 | 3/1979 | Meyers | 229/41 R |
| 4,318,470 | 3/1982 | Montealegre | 229/27 |

*Primary Examiner*—Herbert F. Ross

[57] ABSTRACT

A partitioned carton having a self erecting bottom formed when the carton is squared, and an inter-locking tab projecting from one of the bottom flaps through an aperture in a partition panel connected to the bottom flap opposite the one bottom flap, the locking projection and aperture are shaped so that the locking projection passes into the aperture as the carton is being squared and locks the carton in an erected position to facilitate filling.

11 Claims, 10 Drawing Figures

PARTITIONED CARTON

FIELD OF THE INVENTION

The present invention relates to a partition carton. More particularly, the present invention relates to a longitudinally partition carton having a self erecting bottom structure with an inter-locking mechanism to hold the carton in erected position for filling.

BACKGROUND TO THE INVENTION

It is generally known in top loading cartons for beverages and the like, in particularly beer, to provide a pair of partition forming panels that project vertically from a pair of opposed bottom forming flaps. These cartons may be provided with preglued bottom flaps formed with fold lines delineating the glued edge. Generally, such cartons have both longitudinal and transverse partitions and on squaring from the knock-down position form cartons with mutually transverse partition structures adapted to receive containers in individual compartments. The squaring of the carton automatically erects the bottom of the carton and positions the longitudinal and transverse partition in the appropriate locations. Such a carton is shown, for example, in Canadian Pat. No. 715,402 issued Aug. 10, 1965 to Kotowick.

It is also known to provide handles in the partition structure formed by extensions of the bottom flap of the carton as shown, for example, in U.S. Pat. No. 1,977,102 issued Oct. 17, 1933 to Wheeler and Canadian Pat. No. 458,683 issued Aug. 2, 1949 to MacDonald et al.

BRIEF DESCRIPTION OF THE INVENTION

It is the object of the present invention to provide a one piece carton structure having a self erecting bottom, a longitudinal partition and having a locking mechanism to hold the carton in an erected position after squaring i.e. to inhibit movement of the carton from a squared to a knocked down configuration.

Broadly, the present invention relates to a blank or carton comprising, pairs of side and end walls foldably interconnected by a plurality of substantially parallel fold lines and adapted to form a knocked down sleeve, bottom flaps connected to each of said side and end walls by fold lines substantially perpendicular to said set of fold lines, means interconnecting adjacent pairs of said bottom flaps to provide a self erecting bottom, a partition panel foldably connected to each of said bottom flaps connected to said side walls via a fold line substantially perpendicular to said set of fold lines, each said partition panel terminating in a free end, a hand hole formed in at least one of said partition panels adjacent to the free end thereof, means defining an aperture in one of said partition panels, adjacent its fold line connection to said bottom flap, a projection extending from the bottom flap to which the other of said partition panels is foldably connected, said projection and aperture being shaped and positioned so that said projection enters into said aperture as said knock down sleeve is squared and said self erecting bottom is erected, one edge of said projection engaging with one side of said aperture when said carton is erected to obstruct movement of said squared sleeve toward said knocked down position.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
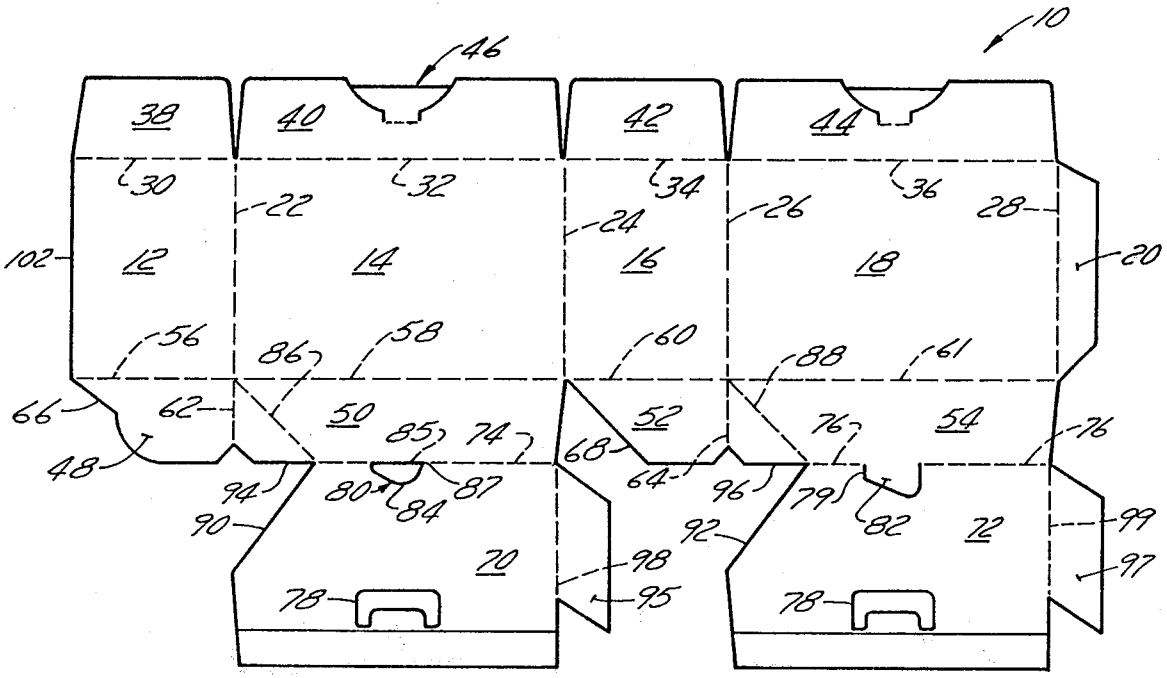
FIG. 1 is a plan view of one form of blank used to construct the present invention.

As shown in FIG. 1, blank 10 comprises an end wall 12, side wall 14, end wall 16, side wall 18, and manufacturer's joint forming flap 20, foldably interconnected by set of parallel fold lines 22, 24, 26 and 28.

Connected to the tops of the panels 12, 14, 16 and 18 via fold lines 30, 32, 34 and 36, are top flaps 38, 40, 42 and 44 respectively. The top flap 40 has been provided with a hand hole access flap generally indicated at 46 and a similar flap may also be provided in the flap 44 (see FIG. 6).

Bottom forming end flaps 48, and 52 and bottom forming side flaps 52 and 54 are foldably connected to the panels 12, 16, 14 and 18 respectively by fold lines 56, 60, 58 and 61.

The adjacent edges of bottom forming flap 48 and 50 are inter-connected via fold line 62, while the adjacent edges of flaps 52 and 54 are inter-connected via line 64 to form pairs of inter-connected bottom side and end flaps.

The bottom end flaps 48 and 52 are cut-away as indicated at 66 and 68 respectively to provide the necessary clearance for erecting the self erecting bottom when the box is squared, as will be described hereinbelow.

The side bottom flaps 50 and 54 have partition panels 70 and 72 respectively connected thereto by interrupted fold lines 74 and 76 respectively. Each of these panels 70 and 72 is preferably provided with hand hold aperture 78. However, depending on the strength requirements one of the partitions may be of reduced height sufficient to provide the aperture 80 or projection 82 to be described hereinbelow without extending to the height of the hand hole.

In the illustrated arrangement, panel 70 has a locking aperture 80 formed therein. This locking aperture in the illustrated arrangement is positioned at the centre line of the side wall 14 and is shaped to receive the locking projection 82 formed in the panel 72. The projection 82 projects from the side bottom flap 54 and is cut from the body of the partition 72 at the mid point of the side wall 18 i.e. the projection 82 interrupts the fold line 76 and divides it into two separate fold lines spaced by the projection 82. The projection 82 and aperture 80 are contoured as illustrated so that when the carton is being squared up, and the partition panels are moving downward and sideways, as the self erecting bottom is being formed the projection 82 is received within the aperture 80 and eventually moves into the position wherein the projection 82 extends through the aperture 80 and is in face-to-face relationship with the bottom flap 50.

As illustrated the aperture 80 has a curved wall 84 that intersects the bottom wall 85 of the aperture at an apex 87, the projection 82 on the other hand, is provided with an abutment face 79 that extends substantially perpendicular to the fold line 76 and engages the curved wall 84 when the carton is erected or squared. The curved wall 84 may also engages the upper edge of face 79 and tend to move the projection 82 toward the inner face of flap 50 as the carton is erected. However, this action also occurs simply by the movement of the bottom flaps as the carton is errected. The purpose of the engagement between the face 79 and wall 84 is to resist movement of the carton from squared toward knock-down condition as will be described in more detail herein below.

To provide the self erecting bottom requires special known means for interconnecting pairs of adjacent bottom flaps that includes providing an extra fold line in each of the bottom side flaps 50 and 52. Such diagonal fold lines indicated at 86 and 88 extend from the points of intersection of the fold lines 22 and 58 and 26 and 61 at an angle of 45° to the fold lines 22 or 26 to the free edge of their respective flaps. The partition panels 70 and 72 are cut away as indicated at 90 and 92 with the cut away portion terminating at the free edge of the flaps 50 or 54 at or inward from the junctions of the fold lines 86 or 88 with the free edges. Free edges of the flaps 50 and 52 have been indicated at 94 and 96 respectively and normally will be extensions of the fold lines 74 and 76 connecting the panels 70 and 72 to the flaps 50 and 54 respectively. The cut aways 90 and 92 permit folding of the flaps 50 and 52 in the areas formed between the fold lines 52 and 86 and 54 and 88 and provide clearance for the bottom end flaps 48 and 52 when the carton is squared.

If desired positioning flaps 95 and 97 may be connected to the partition panels 70 and 72 via fold lines 98 and 99 respectively. The positioning flaps are not essential and have been eliminated from FIGS. 2, 3 and 4 but shown in FIGS. 7 and 8. These flaps are very usefull to insure the partitions 70 and 72 are centred when the carton is squared as will be discubed hereinbelow.

Figure 2:
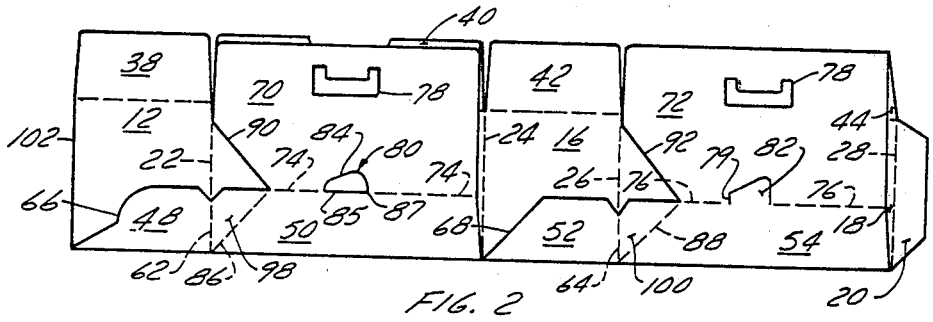
FIG. 2 is a planned view illustrating the first step in the manufacture of a knock-down carton from the blank.

The Knock-down carton will normally be formed from the blank by folding along the fold lines 56, 58, 60 and 61 to position the flaps 48, 50, 52, 54 on top of the walls 12, 14, 16 and 18 respectively and position panels 70 and 72 in an overlying relationship with the walls 14 and 18 and the flaps 40 and 44 respectively as shown in FIG. 2.

Adhesive will be applied to the areas indicated at 98 and 100 formed on the flaps 50 and 52 between the fold lines 62 and 86 and 64 and 88 respectively, or in the corresponding areas in the adjacent end bottom flaps 48 and 52.

The blank is then folded along fold line 26 (and 64) to position the flaps 52 and 54 in face-to-face relationship with the adhesive portion 100 of the flap 54 in contact with the flap 52 to secure same together and to position the partition panels 72 in partial overlying relationship with the partition panel 70.

At this time adhesive may be applied to the upper face of the manufacturer's joint forming flap 20 or it may have been pre-applied thereto and then the blank is folded along the fold line 22 (and 62) to move the flap 48 in face-to-face contact with the flap 50 so that the adhesive in the area 98 of the flap 50 secures the flaps to 18 and 50 together. The later fold also positions the inner face of the panel 12 adjacent the edge 102 (see FIG. 4) and in overlying relationship to the manufacturer's joint forming flap 20 with the edge 102 substantially in line with the fold line 28 thereby to complete the formation of the knock-down carton by securing the flap 20 to the inner face of the panel 12.

Figure 3:
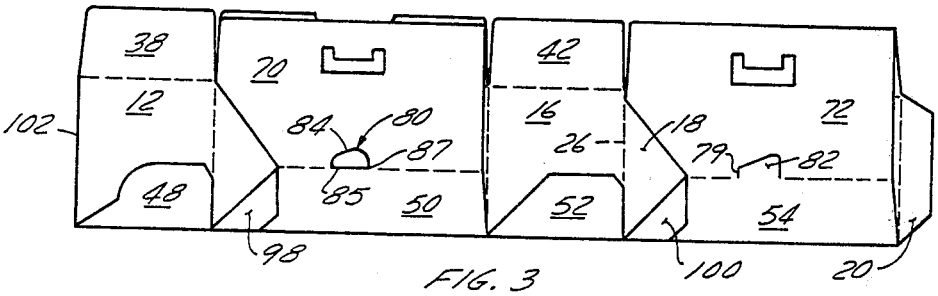
FIG. 3 is a plan view similar to FIG. 2 but showing a modified form of the blank incorporating the present invention.

In an alternate form of the present invention fold lines 62 and 64 are severed i.e. the flaps 48 and 50 are disconnected as are the flaps 52 and 54 and the areas 98 and 100 on these flaps may be folded into the position as illustrated in FIG. 3 i.e. into overlying relationship with the adjacent portion of the flaps 50 and 54 respectively. Thus, the blank of FIG. 3 is essentially the same as the blank in FIG. 1 with the exception that the fold lines 62 and 64 are replaced by lines of severence. Carton is folded in the same manner as described above with respect to FIGS. 2 and 4 but a further folding step may be added by folding the areas 98 and 100 in the overlying position with the flaps 50 and 54 as shown in FIG. 3. At this point, adhesive is applied to the upwardly facing or exposed areas 98 and 100, and then the blank is folded in the same manner as described hereinabove to complete the knocked-down carton.

Figure 4:
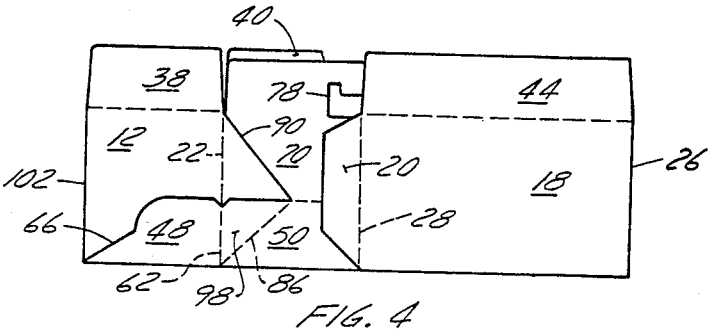
FIG. 4 is a plan view illustrating the next step in the formation of the knock-down carton.

After the knock-down carton has been produced by gluing the flap 20 to the wall 12 and the areas 98 and 100 to the flaps 48 and 52 respectively whether manufactured in accordance with FIGS. 1, 2 and 4 embodiment or the FIG. 3 (7 and 8) embodiment. The carton will be erected by what is known in the industry as a squaring up i.e. the corners of the carton formed by fold lines 22 and 26 will be moved toward each other which will pivot the side and end walls 14, 16 and 18 around the fold lines 24 and 28 respectively in the manner shown in FIG. 5 via the arrow 104 and 106.

Figure 5:
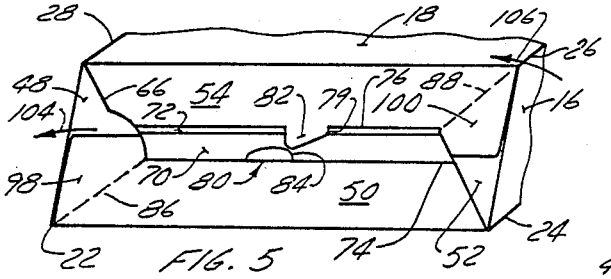
FIG. 5 is a partial isometric view illustrating the movement of the projection through the aperture on squaring up of the carton and erection of the bottom.

This squaring up movement moves the projection 80 into the aperture 80 and forces the left hand edge of the projection 82 in FIG. 5 to the left hand edge of the aperture 80.

After the carton has been squared the projection 82 rests against the inner face of the flap 50 and the abutment edge 79 is urged against the curved wall 84 of the aperture via the inherent tendency of the carton to assume the knock-down position.

Figure 8:
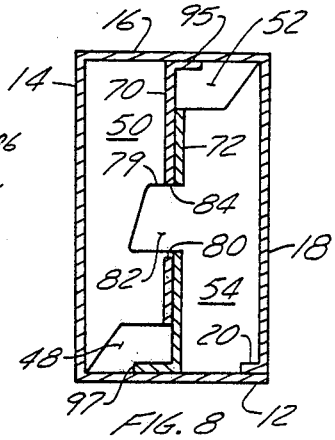
FIG. 8 is a section on line 8—8 of FIG. 7.
Figure 7:
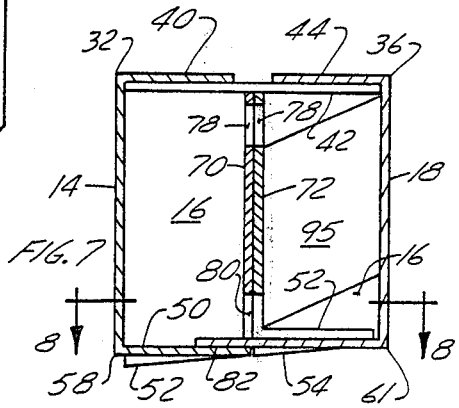
FIG. 7 is a section along the line 7—7 of FIG. 6 of the carton constructed from the blank illustrated in FIG. 3.

As shown in FIGS. 7 and 8 the positioning flaps 95 and 97 are against the end walls 16 and 12 respectively and extend respectively from the partition panels 70 and 72 to the walls 18 and 14 respectively. The flaps 95 and 97 are the same length and sized to automatically position partition panels 70 and 72 in the centre of the carton.

Figure 6:
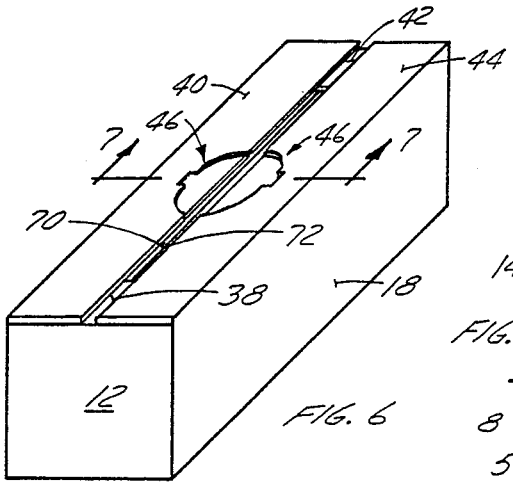
FIG. 6 is an isometric view of a closed carton constructed from the blank of FIG. 1.

The erected and closed carton is illustrated in FIG. 6. The filled carton with the flaps 40 and 44 in closed position can be carried by deflecting the hand hole flap 46 in the flap 40 or 44 into the carton between the bottles contained therein to provide access to the hand holes 78 in the panels 70 and 72. Fingers may be inserted through the passage provided by deflection of the flap 46 and into the aperture 78 and the carton carried in this manner. To open the carton, it is a simple matter to lift the flaps 40 and 44 followed by the flaps 38 and 42 to provide complete access to the contents of the carton.

Figure 10:
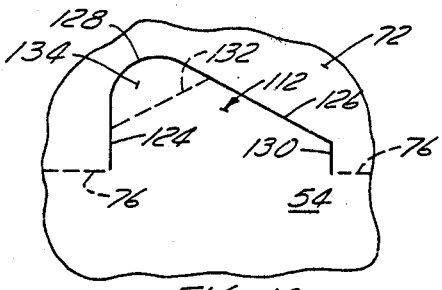
FIG. 10 is a plan view of a projection adapted to be received in the modified aperature of FIG. 9.
Figure 9:
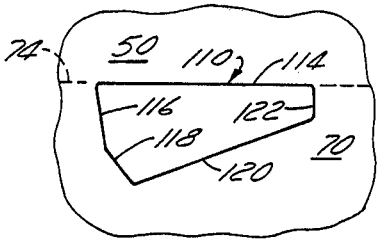
FIG. 9 is a plan view of a modified aperature.

In the arrangement shown in FIGS. 9 and 10 a modified aperture generally indicated at 110 and a modified projection indicated at 112 adapted to replace the aperture 80 and projection 82 in the above described embodiments have been shown. In this arrangement the bottom edge of the aperture 110 is indicated by the line 114 and an abutment wall is provided as indicated at 116. The aperture 110 tapers and is further defined by the walls 118, 120 and 122. Wall 116 extends at an angle of less than 90° approximately 70°-80° to the wall 114 to provide a slight wedging action as will be described hereinbelow. The wall 118 extends at an even lesser angle to the wall 114. The wall 122 is perpendicular to the wall 114, while the wall 120 is at about an angle of 30° (say 20°-40°) to wall 114. These angles are not critical, however it is important that the wall 116 be sloped or otherwise curved to apply a caming action to the projection 112 and that the shape of the operature 110 be such that it is interacts with the projection 112 in the manner described below.

The projection 112 is defined by an abutment edge or wall 124 extending substantially perpendicular from the fold line 76, a sloped wall 126 connected to the edge 124 by a curved section 128 and a wall 130 substantially perpendicularly from fold line 76 to wall 126. The slope of the line 126 is about 30° to the fold line 76.

A fold line 132 extends from the abutment wall 124 to the wall 126, cross the projection 112 at an angle of approximately 20°-30° to the fold line 76. The fold line 132 intersects the abutment wall 124 at a distance spaced from the fold line 176 to provide a length, significantly longer than the thickness of the corrugated board from which the carton is manufactured to provide an extended abutment face adapted to contact with the abutment wall 116 of the aperture 110 over a minor portion of it said length.

In the operation of the modification shown in FIGS. 9 and 10 as the carton is erected as shown in FIG. 5, the tip of the projection defined by the walls 124, 128 and 126 and fold line 132 as indicated by the numeral 134 engages the one face of partition 70 at the edge of the aperture 110 and the wall 118 acts as a cam to lever the section 134 and bend same along fold line 132 relative to the remainder of the projection 112 so that the projection 112 may pass through the aperture 110. The slope of the wall 118 and 116 causes the section 134 to bend at an angle greater than 90° to the remainder of the projection 112 as the projection passes through the aperture 110. Thus, the dimensions projection and particularly the size and position of the section 134 i.e. the length of section 134 beyond the fold line 132 must be correlated with the size of the aperture 110 to ensure that in folded position the curved edge 128 clears the opposite face the partition 70 when the projection 112 passes through aperture 110 and permits the section 134 to snap back into its natural position substantially planer with the remainder of the projection 112. The slope of the wall 116 tends to wedge the projection 112 into face to face ralationship with the bottom flap 50 as the carton is errected.

The modification shown in FIGS. 9 and 10 provides a more secure arrangement rendering collapse of the erected carton from a squared position to a knock-down position very difficult and generally requiring manipulating the flap portion 134 manually before the carton may collapse to knock-down condition. This arrangement permits a maximum lenth of abutment wall 124 from the fold line 132 to the fold line 76 to thereby reduce the possibility of the projection 112 slipping out of the aperature 110.

Having described the invention, modifications will be evident to those skilled in the art without departing from the spirit of the invention as defined in the appended claims.

I claim:

1. A carton blank comprising a first end wall and a first side wall, a second end wall and a second side wall foldably inter-connected by a plurality of substantially parallel fold lines and adapted to form a knock-down sleeve, bottom flaps connected one to each of said end and side walls by fold lines substantially perpendicular to said set of fold lines, means permitting interconnection adjacent pairs of said bottom flaps to form a self erecting bottom when said knocked down sleeve is squared, a partition panel foldably connected to each of said bottom flaps connected to said first and second side walls via fold lines substantially perpendicular to said set of fold lines, said partition panels each terminating in a free end, said bottom flaps and said partitions being cut away to permit erection of said bottom as said sleeve is squared, means defining an aperture in one of said partition panels adjacent its fold lines connection to said side bottom flap to which it is foldably connected, a projection extending from said side bottom flap from which the other of said partition panel is foldably connected, an abutment edge on said projection, said projection being formed from said other partition panel, said projection and aperture being relatively positioned and shaped to cooperate so that said projection enters said aperture as a knock down sleeve formed from said blank is squared from a knocked-down position to an erected position and said abutment edge engages a wall of said aperature to prevent said sleeve from returning to knocked down condition.

2. A blank as defined in claim 1 where said means permitting interconnection said adjacent pairs of said bottom flaps includes a securing area defined in each of a pair of bottom flaps connected to said side walls by free edges of said pair of bottom flaps and fold lines extending to an angle of 45° to said set of fold lines with each said 45° fold line extending from a corner of its flap of said pair of bottom flaps adjacent the other flap of each said adjacent pairs of flaps and being located in diagonally opposite corners when said knock down sleeve is squared.

3. A blank as defined in claim 1 wherein bottom flaps forming said adjacent pairs are interconnected by fold line extensions of the fold line connections between the side and end walls to which said flaps forming said adjacent pairs are interconnected.

4. A blank as defined in claim 1 further comprising a hand hole in at least one of said partition panels adjacent said free end thereof.

5. A blank as defined in claim 1 further comprising a positioning flap foldable connected to each of said partition panels by fold line substantially parallel to said set of fold lines, said positioning flaps being located at respective ends of its said partition panels to extend between its partition panel along an end wall to the adjacent side wall when said knock down sleeve is squared.

6. A blank as defined in claim 1 wherein said projection is divided by a fold line extending from said abutment edge across said projection to define a section that is deflected as it passes through said aperture when said knock down sleeve is squared and then snaps back toward its initial position.

7. A carton comprising a pair of side walls, a pair of end walls, and a manufacturer's joint forming flap foldably inter-connected by a set of substantially parallel fold lines, said manufacturer's joint connecting a pair of adjacent side and end walls to form a tubular knock-down sleeve, bottom flaps foldably connected to said side and end walls, a pair of partition panels foldably connected one to each of said bottom flap connected to said side walls, said partition panels terminating in free ends, a securing area defined on a pair of said bottom flaps connected to said side walls by free edges of said pair of bottom flaps and a fold line extending from a corner of each of said pair of bottom flaps at an angle of 45° to said foldable connections to a free edge of each of said pair of bottom flaps, each said securing area being preglued to the adjacent bottom flap connected to an end wall to form a self erecting bottom in said carton, said securing areas being in diagonally opposite corners of said carton, a projection extending from one of said pair of bottom flaps and an aperture in the partition panel connected to the other of said pair of bottom flaps, an abutment edge formed on said projection, said aperture and said projection being positioned and shaped to permit said projection to pass through said aperture as said carton is being erected from a knocked-down condition by squaring, said abutment edge on said projection engaging with a wall of said aperture to resist collapsing of said carton from a squared condition to a knock-down condition.

8. A carton as defined in claim 7 wherein a pair of immediatly adjacent bottom flaps adjacent said 45° fold lines are inter-connected via a fold line.

9. A carton as defined in claim 7 wherein said partition panels are provided with hand holes adjacent said free ends.

10. A carton as defined in claim 7, 8 or 9 further comprising a positioning flap foldably connected to each of said partition panels, each of said positioning flaps extending from its respective partition panel, in face to face relationship with the adjacent end wall, to the adjacent of said side walls.

11. A carton as defined in claim S7, 8 or 9 wherein said projection is divided by a fold line extending from said abutment edge across said projection to provide a section that is diflected as said projection passes through said aperature when said carton is errected and then snaps back when said projection passes sufficiently through said aperture as said sleeve is squared.

* * * * *